US005666433A

United States Patent [19]

Wehner

[11] Patent Number: 5,666,433

[45] Date of Patent: Sep. 9, 1997

[54] MICROPHONE & LOUDSPEAKER SYSTEM

[76] Inventor: Raymond Wehner, 241 Eveline St., Selkirk, Manitoba, Canada, R1A 1L7

[21] Appl. No.: 387,740

[22] PCT Filed: Aug. 18, 1993

[86] PCT No.: PCT/CA93/00327

§ 371 Date: Apr. 10, 1995

§ 102(e) Date: Apr. 10, 1995

[87] PCT Pub. No.: WO94/05133

PCT Pub. Date: Mar. 3, 1994

[30] Foreign Application Priority Data

Aug. 18, 1992 [CA] Canada ..... 2076288

[51] Int. Cl.[6] ..... H04R 25/00

[52] U.S. Cl. ..... 381/169; 381/155; 381/91; 381/111; 381/205; 181/144

[58] Field of Search ..... 381/91, 205, 155, 381/168, 169, 111; 181/144, 145, 147, 153

[56] References Cited

U.S. PATENT DOCUMENTS 3,995,124 11/1976 Gabr .

4,836,326 6/1989 Wehner ..... 381/91

FOREIGN PATENT DOCUMENTS 77 07594 10/1977 France .

3512155 4/1985 Germany .

*Primary Examiner*—Sinh Tran

*Attorney, Agent, or Firm*—Murray E. Thrift; Adrian D. Battison

[57] ABSTRACT

A sound receiving and sound reproduction apparatus includes a microphone and loudspeaker. The microphone has a cylindrical transducer housing with a centre section and two end sections. The centre section has elliptical and faces that converge mirror-symmetrically downwardly and towards the front of the microphone. The end sections are solid blocks that are spaced from the centre section and have similarly oriented end faces. In the loudspeaker, there are three components, a centre unit with centre and end sections spaced slightly along a common axis and two end components spaced to opposite ends of the centre unit. In each case, the speakers radiate through elliptical gaps that converge upwardly to a centre plane of the loudspeaker unit. Periodic chambers are connected to each of the units of the loudspeaker.

20 Claims, 13 Drawing Sheets

MICROPHONE & LOUDSPEAKER SYSTEM

FIELD OF THE INVENTION

The present invention relates to sound receiving and sound reproduction apparatus.

BACKGROUND

One aspect of the invention relates to a microphone comprising a cylindrical transducer housing with a lateral axis and having a centre section and two end sections, the centre section having non-parallel, elliptical end faces oriented mirror-symmetrically with respect to a plane perpendicular to the lateral axis, the end sections having inner end faces confronting and parallel to respective ones of the centre section end faces, and microphone transducers mounted to receive sound from beween the respective end sections and the centre section.

Another aspect of the invention relates to a loudspeaker comprising:

a cylindrical, hollow housing with a lateral axis and having a centre section and two end sections, the centre section having non-parallel end faces oriented mirror-symmetrically with respect to a plane perpendicular to the axis, the end sections having inner end faces confronting and parallel to respective ones of the centre section end faces; and four speaker transducers mounted in the housing, with two centre transducers in the centre section radiating towards respective ones of the end sections, and one end transducer in each of the end sections radiating towards the centre section, each transducer being sealed to the housing.

A microphone and a loudspeaker of these types are disclosed in EP-A-0 256 688 (CA-A-1 282 711, granted 9 Apr. 1991 to Raymond Wehner, the applicant in this application).

CA-A-1 060 350, granted 14 Aug. 1979, and EP-A-0 256 688, describe microphone and loudspeaker systems that are directed to the recording and open-air reproduction of sound fields so that the reproduced sound field includes the directional and range information from the originally recorded field for detection by the human hearing system. Microphones in these systems are intended to be analogs of the human hearing system, detecting the range and direction sound information that would be detected by the human hearing system. The loudspeaker aspect of the system exemplifies the Hamilton-Jacobi theory of wave movement.

The loudspeakers are intended to invert the detection process and to generate a sound field containing the direction and range information originally available.

SUMMARY

The present invention is concerned with certain improvements in the earlier systems.

According to one aspect of the present invention there is provided a microphone of the above described type that is characterized in that: the inner end faces of the end sections are imperforate; and only two microphone transducers are used, mounted centrally of the end faces of the center section.

This microphone retains the concept of converging sensing gaps or slots of the optimal shadow omniphonic microphone disclosed in EP-A-0 256 688, but uses only two transducers and solid baffles as the end sections. In use, the microphone is arranged with the end faces of the centre and end sections lying in planes that converge downwardly and to the front. The planes preferably intersect at the dihedral angle of a regular tetrahedron (70° 32').

It is also preferred that the microphone housing is of circular cross-section so that the confronting end faces of the sections are elliptical.

The outer end faces of the housing are preferably parallel to the inner end faces of the respective end sections.

According to another aspect of the present invention there is provided a loudspeaker of the above type characterized by:

the end sections having closed outer ends;

baffle means extending across the centre section between the two centre transducers;

aperiodic chamber means; and means communicating between the housing at the back side of each transducer and the aperiodic chamber means.

Each transducer thus radiates from an enclosure with a total air volume that includes the volume of the respective aperiodic chamber. The volume can be chosen to match the compliance and other characteristics of the transducer. The chamber is intended to have no inherent resonant or colouring qualities.

This aspect of the invention also provides a loudspeaker comprising a centre unit as characterized above and wherein:

the centre unit has opposite left and right ends, the end sections comprise a left end section and a right end section, the four speaker transducers mounted in the housing include centre left inner and centre right inner transducers in the centre section radiating towards the left and right end sections respectively and centre left outer and centre right outer transducers in the left and right end sections respectively radiating towards the centre section, each transducer extending across and closing the housing; and further comprising:

left and right end units including respective cylindrical housings with respective lateral axes aligned with the lateral axis of the centre unit, the left and right units being spaced from the left and right ends respectively of the centre unit, each of the left and right end units having a centre section and two end sections at opposite ends of the centre section, each centre section having inner and outer end faces parallel to the adjacent end faces of the centre unit centre section, each end section of each end unit having an inner end face confronting and parallel to a respective one of the end faces of the end unit centre section;

two speaker transducers mounted in the left end unit centre section, including end left outer and end left inner transducers radiating towards the left and right ends respectively of the left end unit centre section; and two speaker transducers mounted in the right end unit centre section, including end right outer and end right inner transducers radiating towards the left and right end faces respectively of the right end unit centre section.

Each end unit end section preferably has a centre through port, aligned with the axis. A baffle divides the space in the end unit centre section between the transducers into two chambers that communicate with respective aperiodic chambers: The end units are thus similar in configuration to the centre unit.

The aperiodic chambers are connected to the speaker housings using tubular ports equipped with vibration dampers. The aperiodic chambers themselves are filled with low-density fractal-like bodies to make the chamber vibration responses aperiodic.

BRIEF DESCRIPTION OF THE DRAWINGS

In the accompanying drawings, which illustrate exemplary embodiments of the present invention.

DETAILED DESCRIPTION

Figure 1:
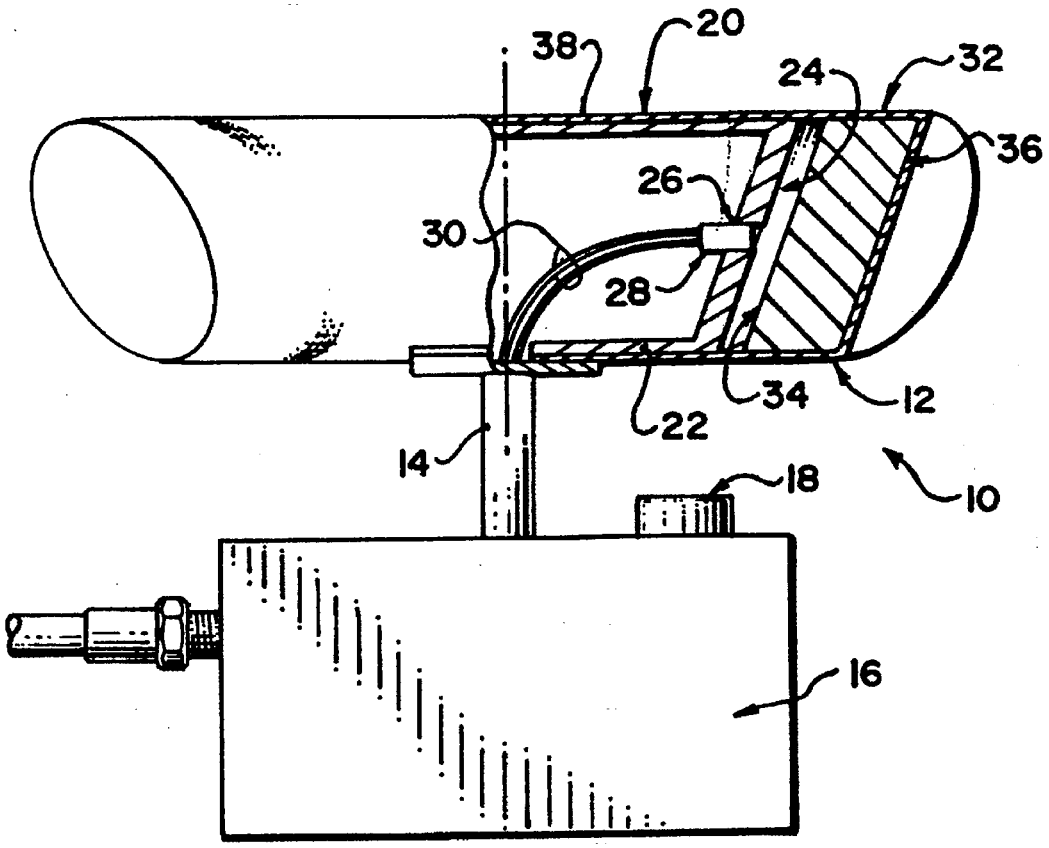
FIG. 1 is a front view of a microphone, one-half of which is shown in cross-section.
Figure 2:
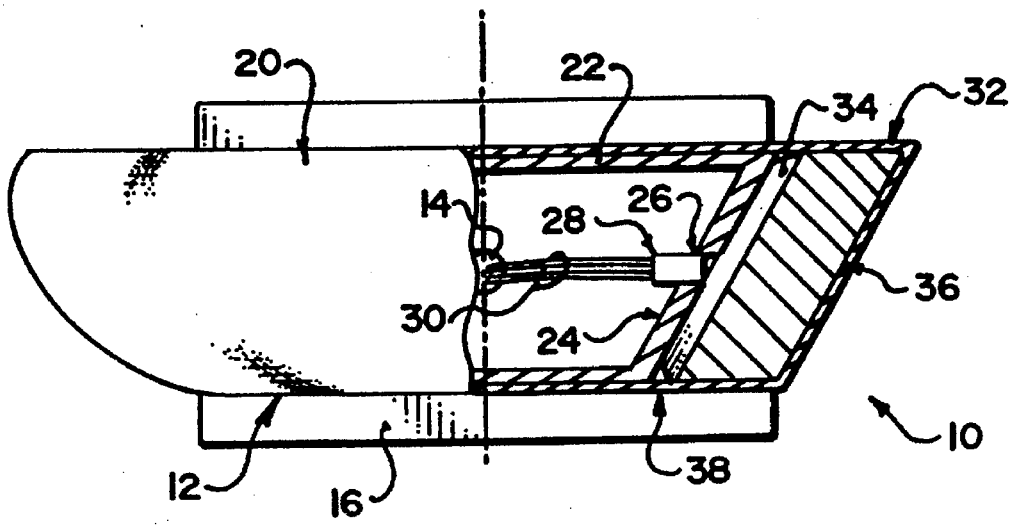
FIG. 2 is a top view of the microphone, with one-half of the microphone shown in cross-section.
Figure 3:
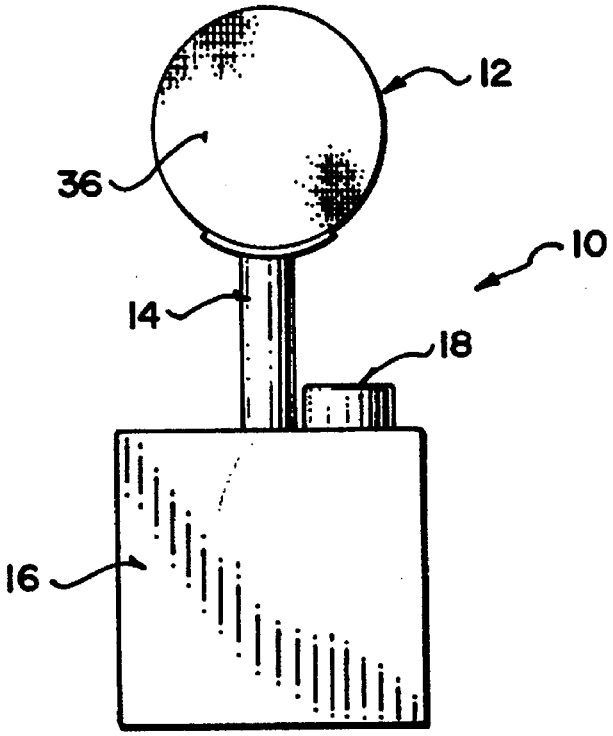
FIG. 3 is an end view of the microphone.
Figure 7:
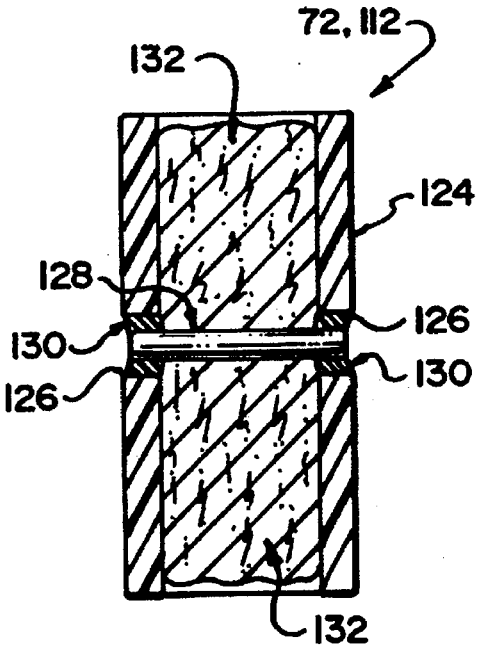
FIG. 7 is an axial cross-section of a port.
Figure 4:
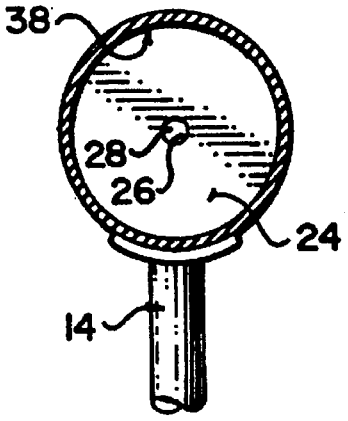
FIG. 4 is an end view of the microphone with the end section removed.
Figure 5:
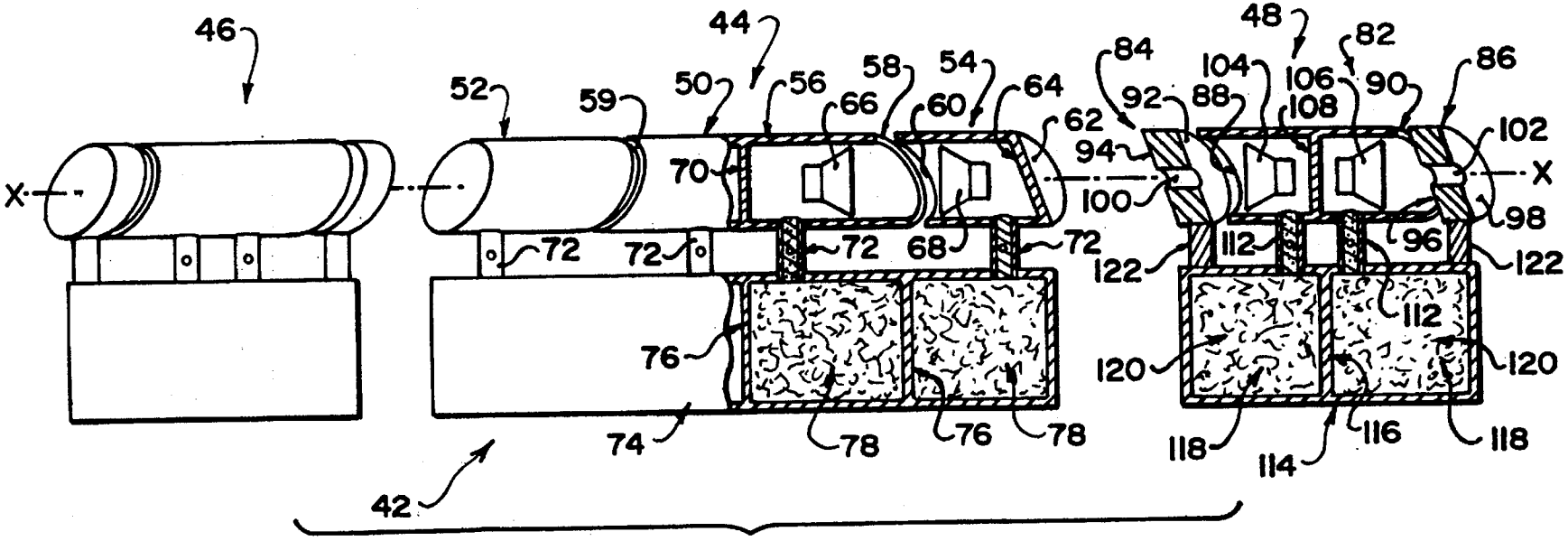
FIG. 5 is a front view of the loudspeaker with one-half shown in cross-section.
Figure 6:
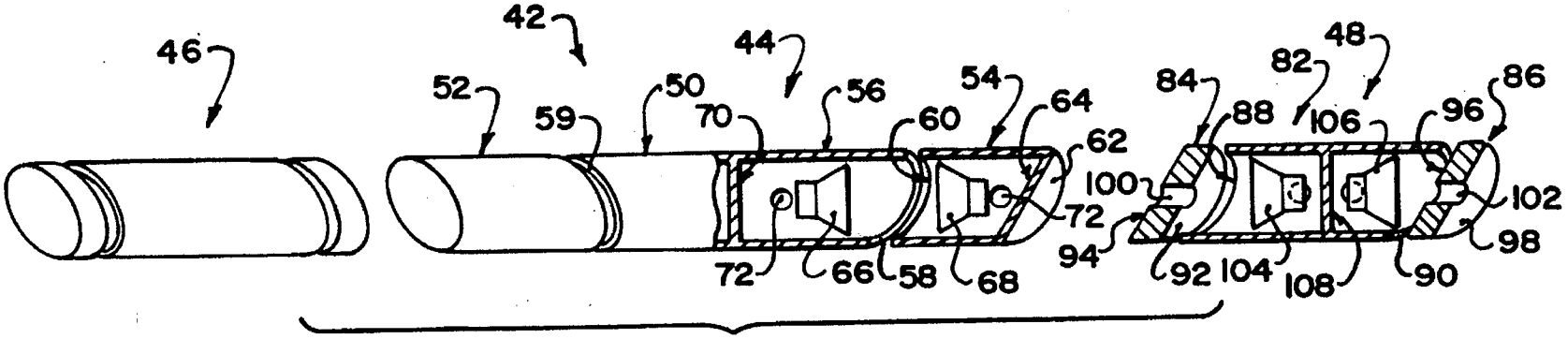
FIG. 6 is a top view of the loudspeaker with one-half shown in cross-section.

Referring to FIGS. 1 through 4 of the accompanying drawings, there is illustrated a microphone 10 having a housing 12 supported by a standard 14 on a base 16. The base is equipped with a spirit level 18 so that the microphone can be properly leveled for use.

The microphone housing has a centre body with a cylindrical sidewall 22 and elliptical end walls 24 that slope downwardly and inwardly towards the front in planes that intersect at the dihedral angle of a regular tetrahedron. The long axis of each end face is oriented at an angle of 45° to the horizontal.

Each end wall 24 has a central bore 26 accommodating a microphone transducer 28. The electric leads 30 from the transducer run through the standard 14 into the base 16. The microphone is also equipped with two end sections 32. Each end section has an inner end face 34 confronting and parallel to the outer face of the adjacent end wall 24 and an outer end face 36 parallel to the inner end face 34. The end section is cylindrical like the centre section 20 but is a solid body rather than being hollow like the centre section. The centre and end sections 20 and 32 of the microphone are covered with an appropriate fabric material 38 that is acoustically transparent, at least where it covers the gaps between the centre and end sections.

FIGS. 5 through 9 illustrate a loudspeaker and components of the loudspeaker intended for use in reproducing sound recorded using the microphone 10. The loudspeaker 42 has a centre unit 44, a left end unit 46 and right end unit 48. The three units are all aligned on a common lateral axis x—x. As illustrated most particularly in FIGS. 5 and 6, the centre unit 44 has a centre section 50, a left end section 52 and right end section 54. The loudspeaker is mirror symmetrical about a centre vertical plane so that the left end of the centre section 50 is of the same configuration, but reversed, with respect to the right end.

The centre section 50 of the loudspeaker has a cylindrical housing 56 with elliptical end faces 58 and 59 that converge upwardly and to the front. The planes containing the end faces intersect at the dihedral angle of a regular tetrahedron.

The right end section of 54 has an inner end face 60 that is parallel to and confronts the end face 58. The outer end face 62 of the right end section is parallel to the inner end and closed by an end wall 64. The ends 58 and 60 of the centre and end sections are open.

A speaker transducer 66 is located on the inside of the housing of centre section 50 and radiates towards the end 58. This is referred to as the centre right inner transducer. A centre right outer transducer 68 is located in the right end section 54 and radiates towards the inner end face 60 of that section. The transducer 68 is referred to as the centre right outer transducer. Symmetrically arranged centre left inner and centre right outer transducers are located at the left end of the centre unit 44.

A vertical baffle 70 separates the interior of the centre section 50 between the centre right inner and centre left inner transducers. Thus, the transducers radiate towards the elliptical gaps between the centre and end sections and radiate backwards into individual enclosures defined by respective sections of the housing. The enclosures on the back side of the transducers communicate through vertical tubular ports 72 with the interior of a housing 74 that is internally separated by walls 76 into a series of aperiodic chambers 78. Each aperiodic chamber communicates with the backside of a respective transducer through a respective port. The aperiodic chambers are filled with light weight, fractal-like bodies, e.g. popcorn.

The end units 46 and 48 of the speaker are similarly constructed but mirror-symmetrical. The right end unit 48 will be described in the following, it being understood that the left end unit is of the same construction.

The right end unit 48 includes three aligned cylindrical sections, a centre section 82, a left end section 84 and a right end section 48. The centre section has two elliptical end faces 88 and 90 that are parallel to one another and to the end faces 58, 60 and 62 of the centre unit. The left end section 84 has inner and outer end faces 92 and 94 that are parallel to the end faces 88 and 90. Similarly, the right end section 86 has inner and outer end faces 96 and 98 parallel to the end faces 88 and 90.

While the centre section 48 is hollow, the end sections 84 and 86 are solid blocks with axial bores 100 and 102 respectively.

Within the centre section 82 of the right end section 86 are an end right inner transducer 104 and an end right outer transducer 106. These are speaker transducers that face inwardly and outwardly respectively towards the end faces 88 and 90. A vertical baffle 108 divides the interior of the centre section 82 into two enclosures on the back sides of the respective transducers.

Two ports 112 communicate between the enclosures and the interior of a housing 114 divided by a wall 116 into two aperiodic chambers 118. Each of the aperiodic chambers communicates with a respective one of the enclosures through a respective port. The aperiodic chambers are filled with fractal-like bodies 120, e.g. popcorn. Two vertical supports 122 support the end sections 84 and 86 respectively on the top of the housing 114.

Each of the ports 72 and 112 is constructed with internal sound damping to minimize resonance effects. The duct has two bores 126 in its wall at diametrically opposed positions. The ends of a steel rod 128, acting as a vibrating body, extend into the bores. The rod 128 is smaller in diameter than the bores, and the free space around the rod is filled with a viscous sealing material 130, in this case a pipe thread sealant. The duct is filled with a self-damping fibrous material 132, in this embodiment super fine steel wool. The rod will, as a free body, vibrate when stimulated by sound vibrations. The vibrations will be damped by the viscous sealant and the steel wool.

Figure 8:
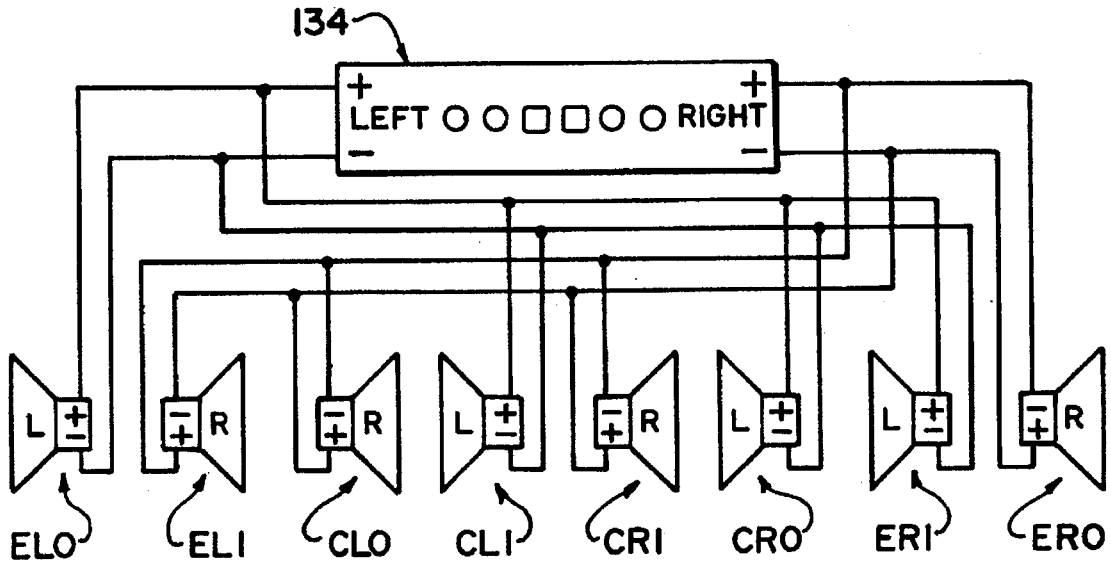
FIG. 8 is a schematic diagram showing the speaker transducer connections to a conventional stereophonic sound source.

As illustrated schematically in FIG. 8, the various transducers of the system are connected to a stereophonic amplifier 134. The centre left outer, centre right inner, end left inner and end right outer transducers are all connected to the right channel output of the amplifier, while the other transducers are connected to the left channel output.

Figure 9:
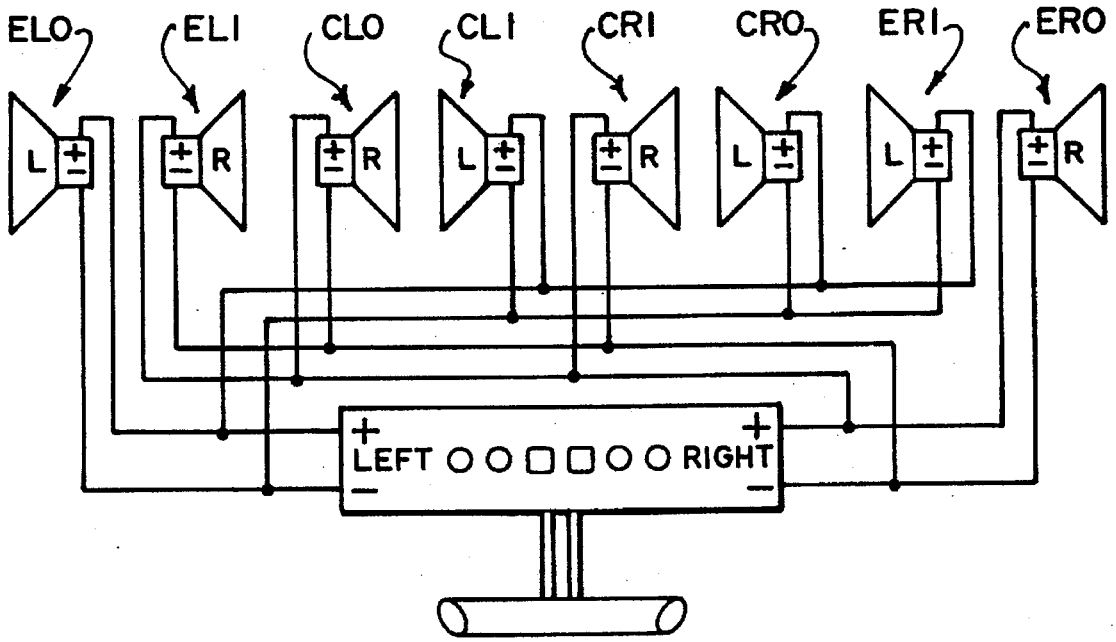
FIG. 9 is a schematic showing the speaker transducer connections to a source of signals recorded using the present microphone.
Figure 10:
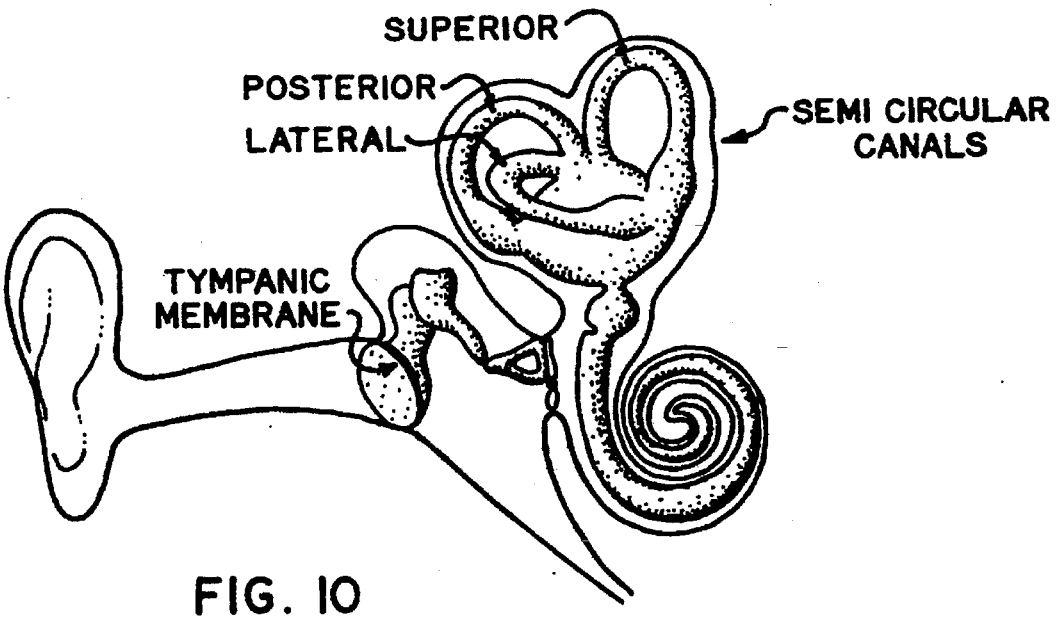
FIG. 10 is an illustration of the outer and middle ear showing the tympanic membrane and the semi-circular canals.

In FIG. 8, the connections to the amplifier are arranged for reproduction of a conventional stereophonic recording. In that case, the speakers connected to the left and right channel outputs of the amplifier have their phases reversed. In FIG. 9 the speakers are connected to reproduce sound recorded using the microphone of this invention. In this case, the phases are all the same.

To achieve the most effective reproduction, it has been found that the amplitude ratios of the signal supplied to the various transducers should be properly selected. Thus, the centre left outer, centre right outer, end left inner and end right inner transducers should be supplied with a signal at an amplitude ratio of 9:1 respect to the signal supplied to the centre left inner and centre right inner transducers. The remaining two transducers, the end left outer and end right outer transducers, should be supplied with power at an amplitude ratio of 5:1 to the centre left inner and centre right inner transducers.

THEORETICAL CONSIDERATIONS

The human hearing system receives information that can be classified as:

sound spectrum information;

sound direction information;

sound range information.

Much effort has been given to the development of systems for faithfully recording and reproducing sound spectrum information. The present concern is with the direction and range information.

In the recording and reproduction of sound, various systems have been proposed to provide an accurate recording and reproduction of the original sound field. Proposed solutions include conventional stereophonic (two channel) systems; quadraphonic (four channel) systems; the dummy head stereophonic system; and various other multiple speaker systems including the four speaker system proposed in Pierce, John Robinson: "The Science of Musical Sound", pp. 160–162. The Pierce text states the conventionally held belief that it is not possible for multiple listeners to share electronically reproduced sound equally, except with headphones. Pierce also discusses the problem of sound direction in a sound recording and reproduction system. With a conventional stereophonic system, there are only two sound directions, one from each channel. Quadraphonic sound purports to be an improvement by providing two additional sound directions. Pierce proposes a four speaker array that will produce particularly accurate reproduction of a sound field at a single point centered on the four speakers. The entire thrust of this prior art is to transmit sound at the listener from as many directions as possible.

This problem of recording and reproducing sound direction can be approached from another point of view. The human hearing system has two channels. It is stereophonic. The sound information received by this system is sufficient to provide the human brain with the sound direction and range information that we want to record and reproduce. It should thus be possible to do this with a stereophonic (two channel) system. This has been achieved using a dummy head for recording, and earphones for reproduction. In this system, the head is designed to be as closely as possible an accurate representation of a human head. The microphones are located in the ears of the dummy head to record all of the sound information that would be received by the ears of a human head at the same place. The earphones reproduce the recorded sound information in a listener's ears. The accuracy of recording and reproduction of the sound directional information using this technique is known. However, the significant cost and complexity of the dummy head and the requirement to reproduce the sounds through earphones to receive all of the recorded sound information are disadvantages.

If two microphones are spaced apart on opposite sides of an object, the interference of the object with the sound propagation to the microphones will vary according to the direction from which the sound is arriving and the distance to the sound source. There will therefore be a difference in the sound field at the two microphones and this difference is a function of the sound direction and range. This phenomenon also occurs with human hearing. The difference in sounds detected by the two ears is used by the brain to decode the direction from which the sound is arriving. The published literature on this topic includes MCFADDEN, Dennis and PASKENEN, Edward G., "Binaural Beats at High Frequencies" Science, Volume 190, No. 4121, Oct. 24, 1975, p. 394.

It may then be speculated that if an appropriate shaped object is positioned between two appropriately positioned microphones, the microphones will experience and record sound fields containing the directional and range information used by the human brain to determine sound location. The question then becomes what system geometry will produce the required results. Both anatomic and psychoacoustic factors are to be considered.

In the human hearing system, the tympanic membranes (ear drums) are elliptical and lie in planes that appear to converge at the dihedral angle of the regular tetrahedron.

The line of intersection of the two planes is oriented at about 45° to the horizontal in the normal, head up position. It is proposed that a similar geometry would be appropriate for stereophonic recording of sound fields. It is then necessary to determine an appropriate geometry and to describe it.

It has been proposed that an appropriate set of mathematical coordinates to describe natural phenomena is not the conventional cartesian three axis system but a four axis system that is described in Buckminster Fuller" "Synergetics: Explorations in the Geometry of Thinking", McMiilan Co. Inc. 1975 876 pp.

It is also believed that a naturally occurring coordinate system other than the cartesian coordinate system and equivalent to the Fuller four axis coordinate system is used in the human listening system for decoding sound information.

On the basis of this hypothesis, it was predicted that a tetrahedrally shaped object placed centrally between two microphones would yield not only the expected stereophonic recording but would also record correct direction and range information that could be interpreted by the human brain. Trials with this concept established that direction information was encoded, that it was encoded correctly, and that it could be decoded by the human brain using open air earphones where;

1. the object had the shape of a regular tetrahedron.

2. the microphones and centre of volume of the tetrahedron were placed on a single horizontal axis; and 3. one face of the tetrahedron was horizontal and above the remaining faces of the tetrahedron.

A microphone designed in this way is referred to as an optimal shadow microphone and is described in the applicant's Canadian Patent 1,060,350.

In a subsequent development, an omniphonic microphone that retained the tetrahedral geometry with respect to the transducer input but omitted the tetrahedron body was produced. Again, favourable results were achieved.

The most recent development is the syntropic microphone based on a vector equilibrium (cuboctahedron) model of human hearing. The microphone provides for geometrically patterned reception of sound energy that yields direction and range information with respect to a single nuclear point.

To relate this model to the human hearing system it is noted that the human vestibular system functions to provide horizontal and vertical alignment placing the hearing apparatus in the anatomical (orthogonal) position for an accurate determination of sound direction and range.

Figure 11:
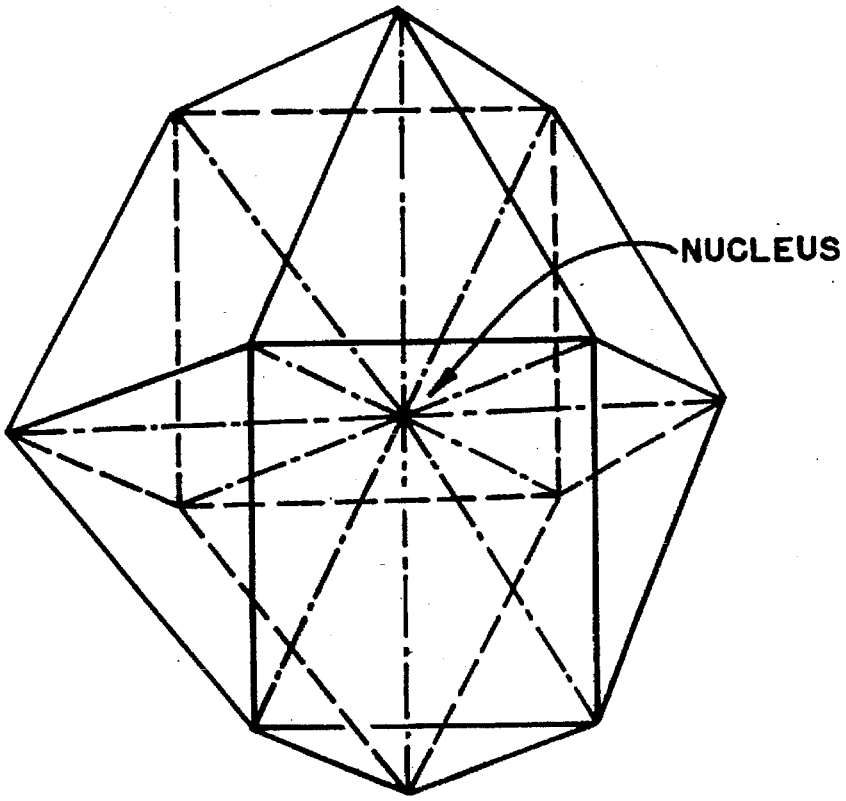
FIG. 11 illustrates a vector equilibrium.
Figure 14:
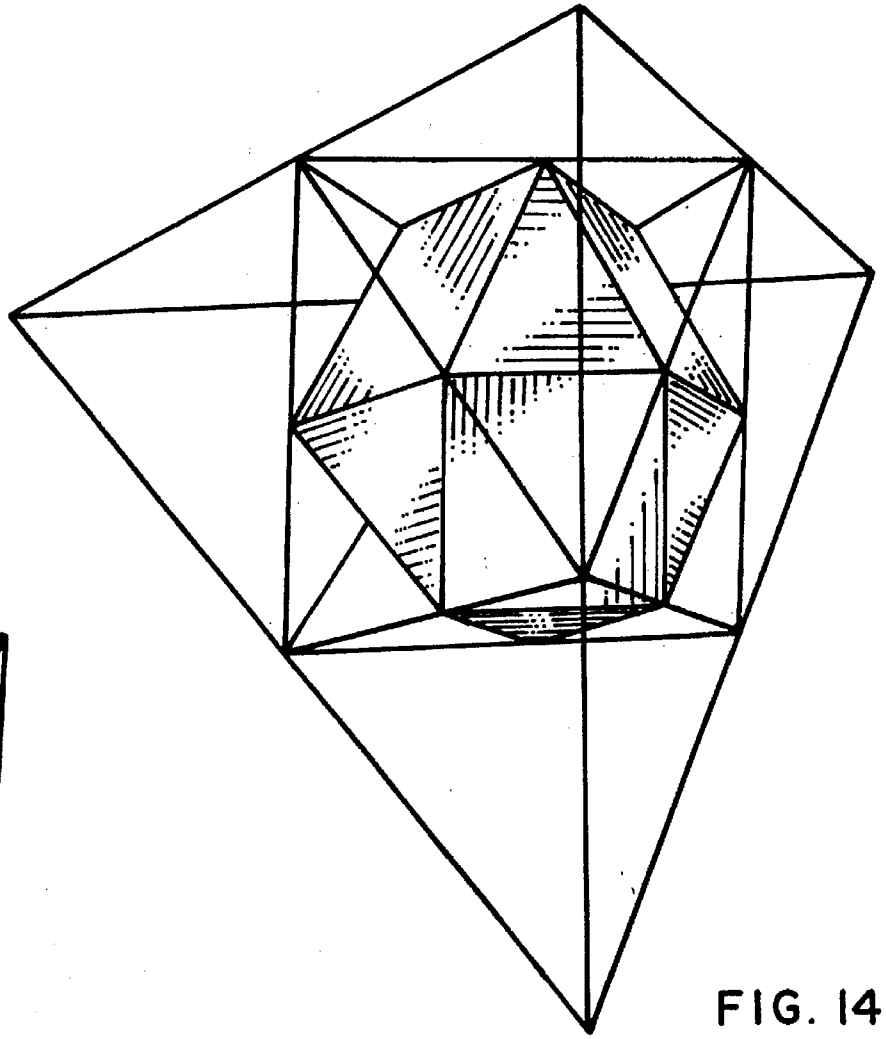
FIG. 14 illustrates a superimposition of the tetrahedron, the octahedron and the vector equilibrium of FIGS. 11, 12 and 13.
Figure 13:
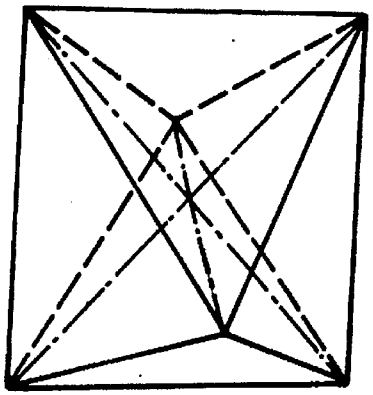
FIG. 13 illustrates a regular octahedron in the orthogonal position.
Figure 12:
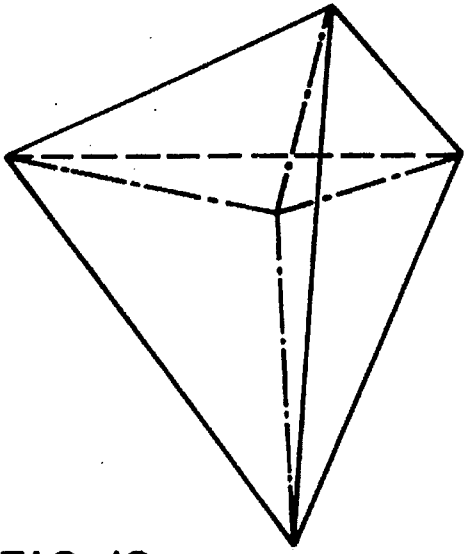
FIG. 12 illustrates an orthogonally oriented regular tetrahedron.

It is observed that there is a planar correspondence between the planes of the superior, posterior and lateral semi-circular canals and the three planes of a spherical octahedron when placed in the orthogonal position. As observed above, there is also a planar correspondence between the human tympanic membranes and two planes of an orthonogally placed regular tetrahedron. It is believed that in determining the direction of a sound source, the human hearing system uses as a reference a single point, i.e., the hypothalamus. Geometrically, this corresponds to the nuclear point of a vector equilibrium (cuboctahedron) as shown in FIG. 11. The vector equilibrium may be related to the orthogonally oriented regular tetrahedron (FIG. 12), corresponding to the orientation of the tympanic membranes and to a regular octahedron (FIG. 13) corresponding to the three planes of the semi-circular canals. The superimposed figures are illustrated in FIG. 14.

These geometrical relationships are used as the basis for an analysis of certain experimental data generated by Mr. Gilbert Wehner in the use of a tetrahedron based optimal shadow microphone as a hydrophone and the subsequently developed omniphornic microphone in air. Experimental data are illustrated in FIGS. 15 through 21 and described in the following examples.

EXAMPLE 1

Figure 15:
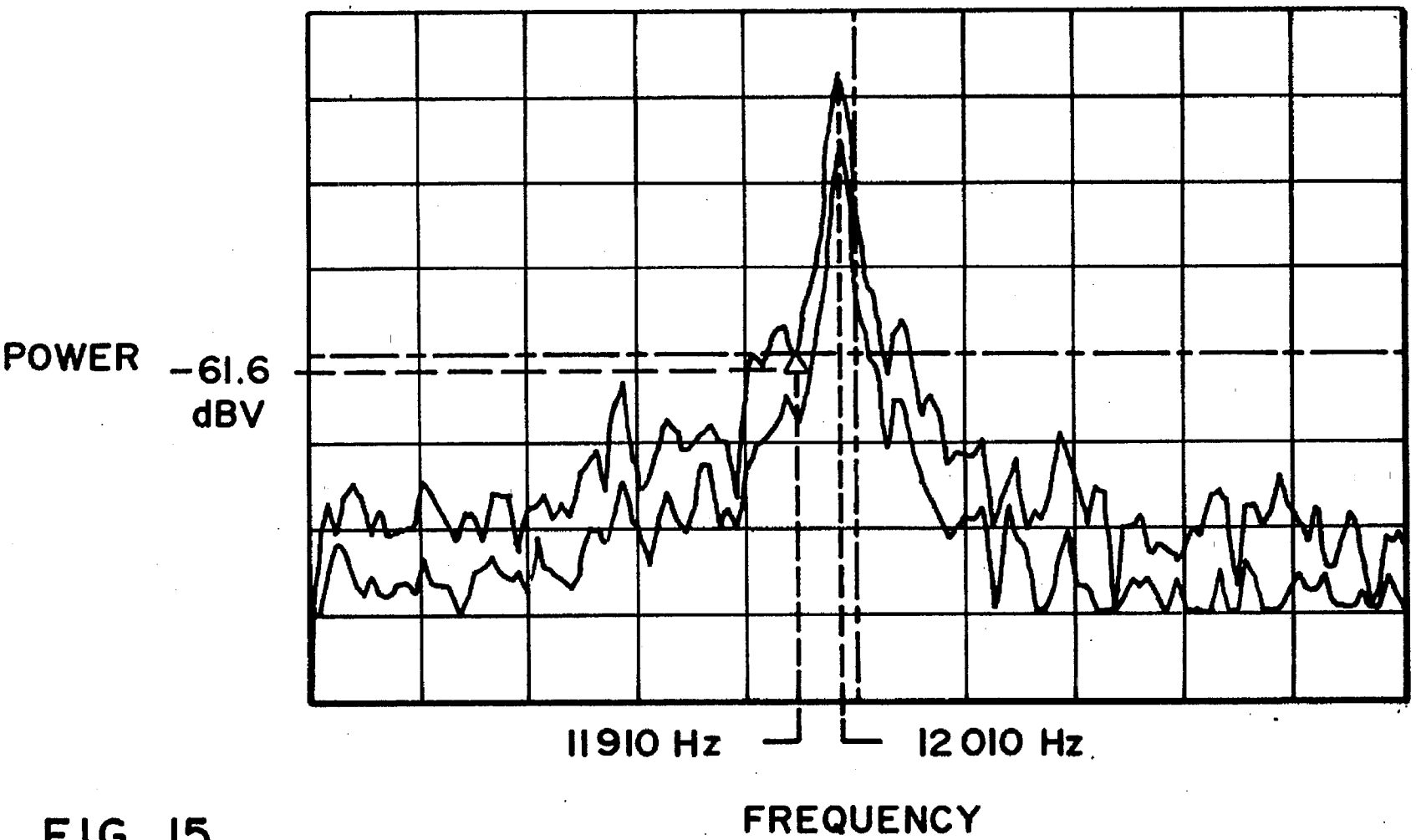
FIGS. 15 and 16 are plots of frequency vs. sound pressure generated from tests using an optimal shadow microphone as a hydrophone.
Figure 16:
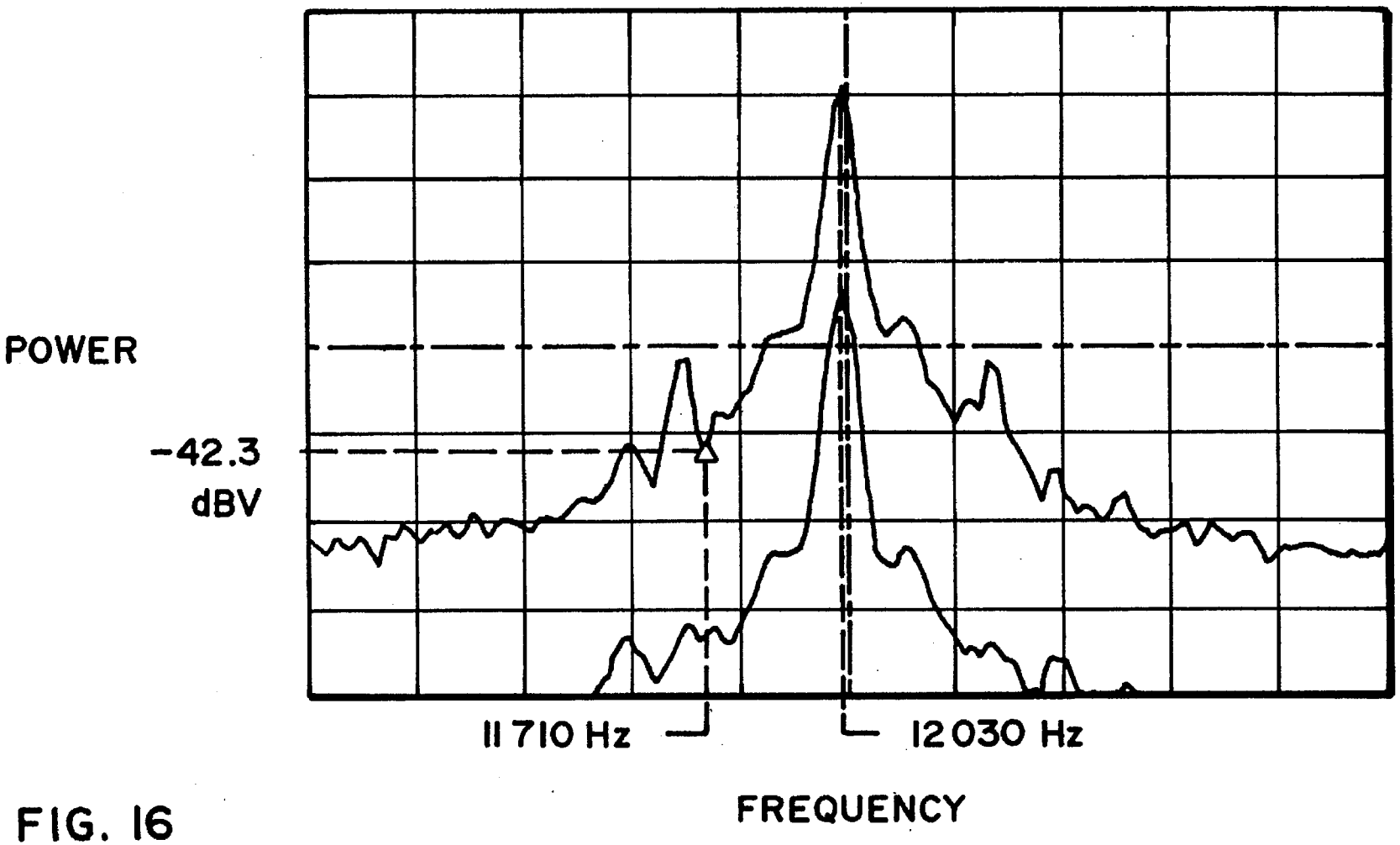

Using an optimal shadow microphone as a hydrophone and a sound source approximately 45 feet (13.5 meters) from the microphone, the power spectra graphed in FIG. 15 were generated. The two plots of frequency versus amplitude represent the responses of the two channels (left and right) of the microphone. It will be observed that there is a sharp peak at 12,010 Hz and an adjacent minimum at 11,910 Hz.

EXAMPLE 2

A test similar to Example 1 was conducted using a sound source approximately 15 feet (4.5 meters) from the microphone. This yielded power spectra plotted in FIG. 16. In this case, there is a sharp power peak at a centre frequency of 12,030 Hz and a minimum at 11,710 Hz.

EXAMPLE 3

Figure 17:
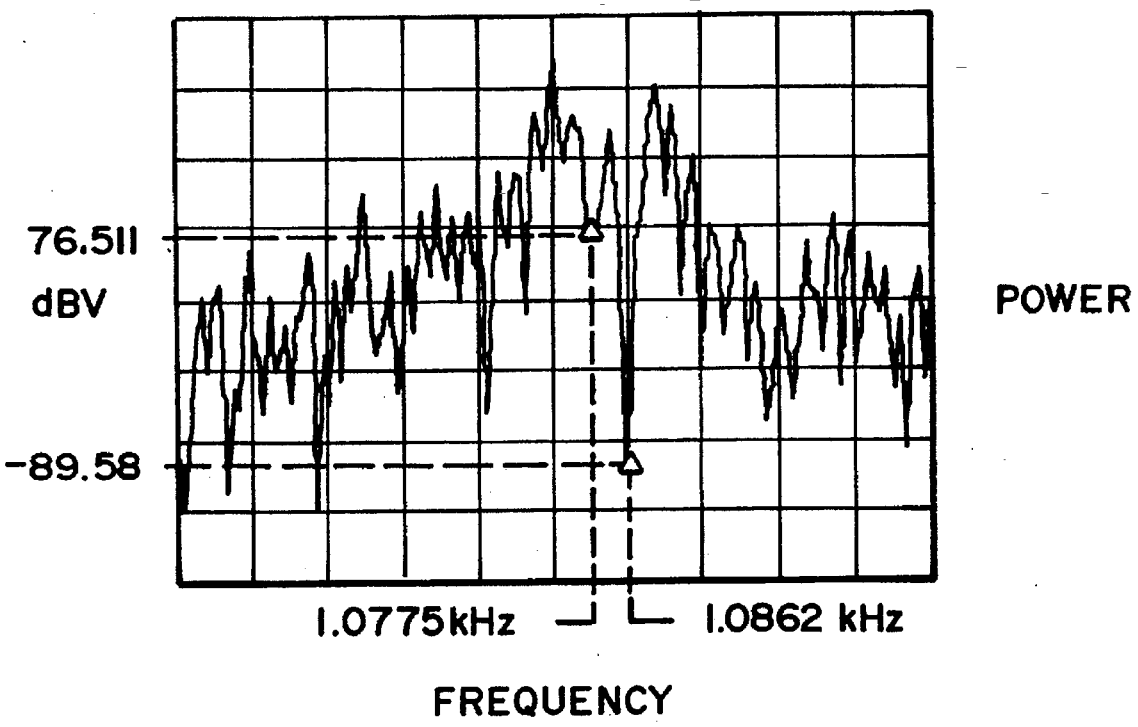
FIG. 17 is a plot like FIGS. 15 and 16 using an omniphonic microphone in air.

The data shown in FIG. 17 were collected using an omniphonic microphone in air. In this case, two marker positions are selected at the sharp minimum points at 1.0775 kHz and 1.0862 kHz. The sound source was estimated to be approximately 40 meters from the microphone.

EXAMPLE 4

Figure 18:
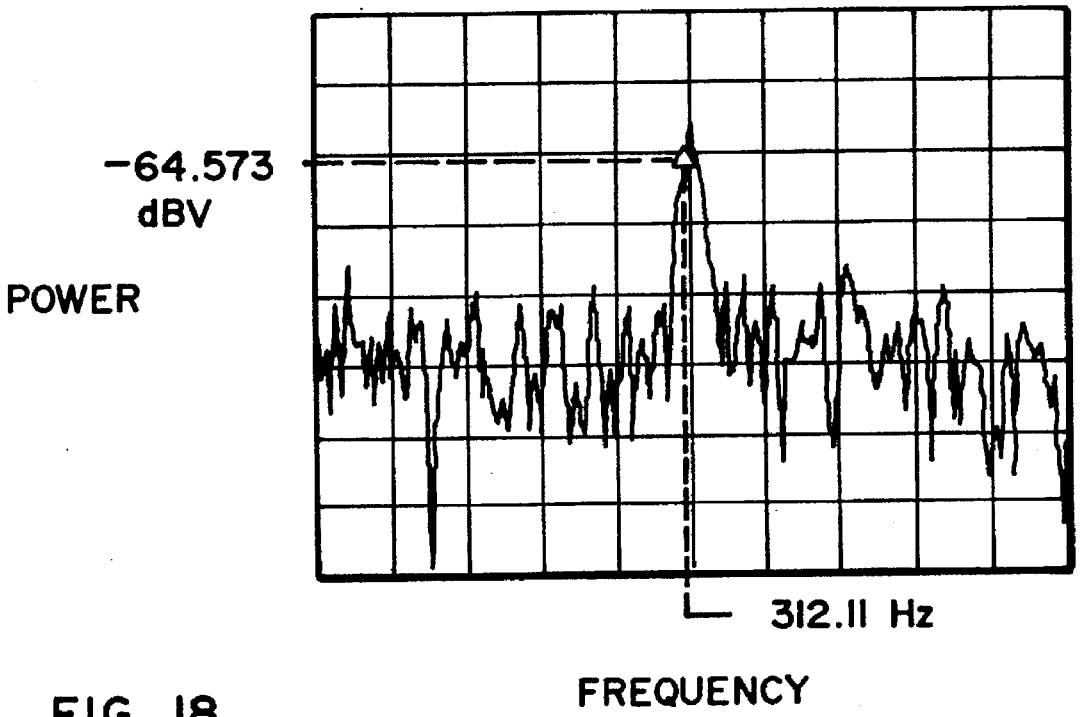
FIG. 18 is a plot like FIG. 17 for a remote sound source.
Figure 19:
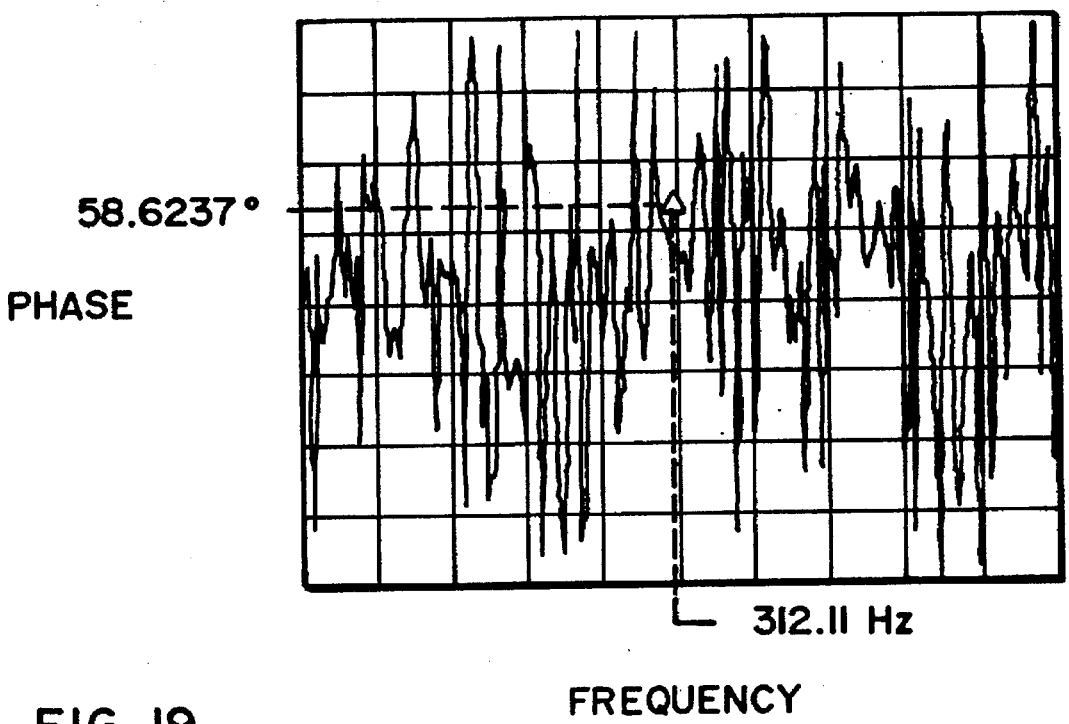
FIG. 19 is a plot of the same test as FIG. 18 but showing the phase difference between the right and left channels vs. frequency.
Figure 20:
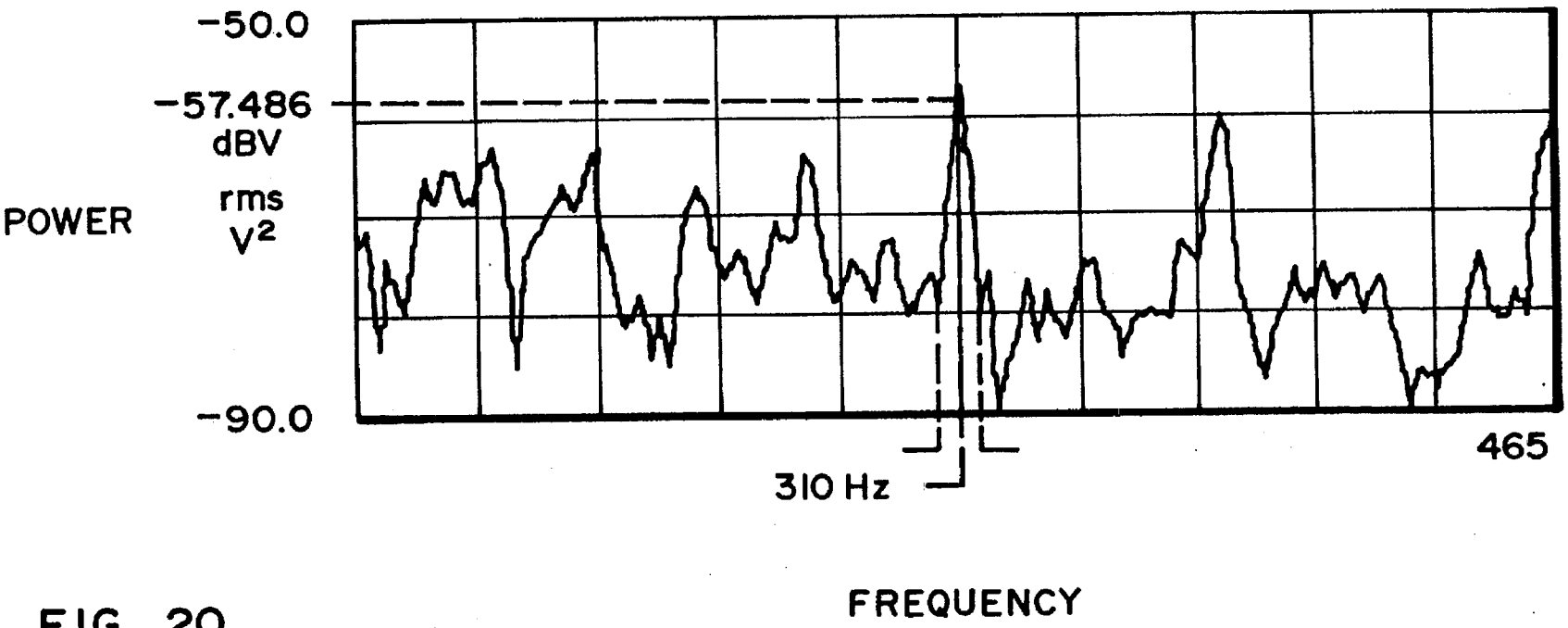
FIGS. 20 and 21 are plots similar to FIGS. 18 and 19.
Figure 21:
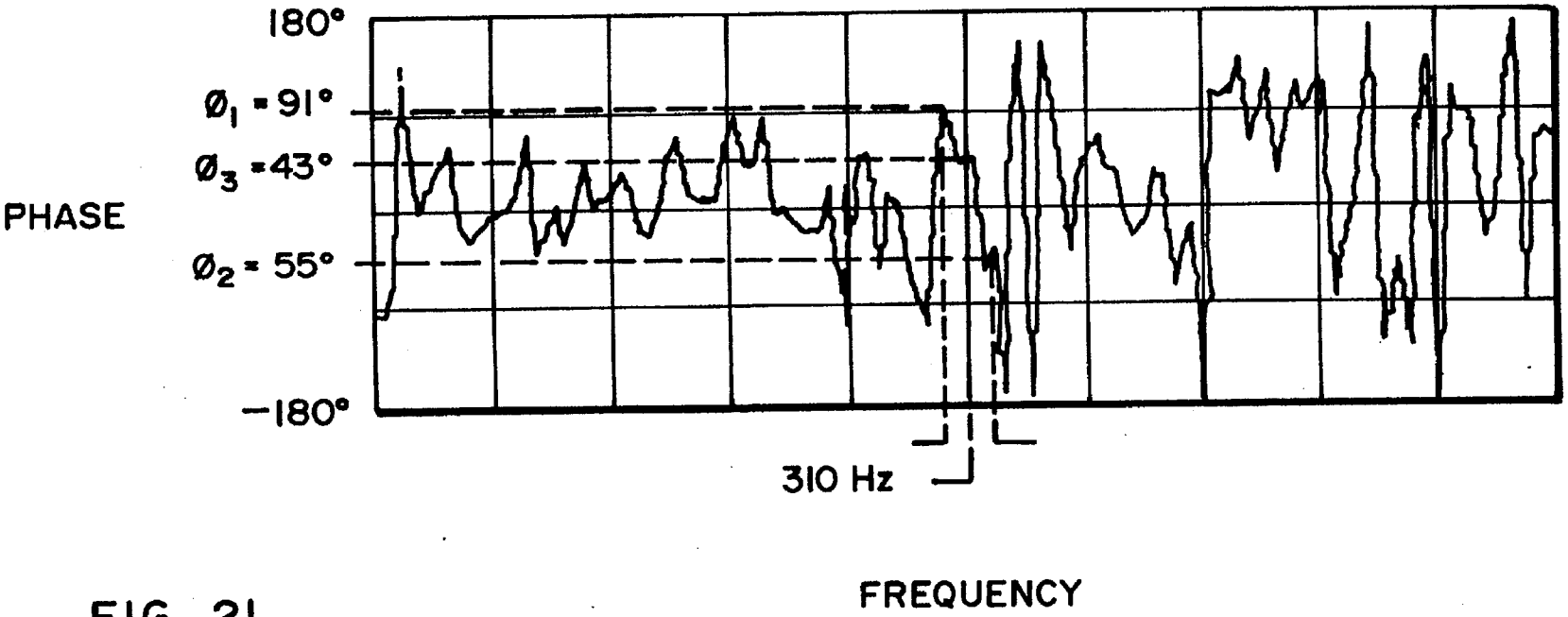

FIGS. 18 and 19 record information gathered using an omniphonic microphone and a sound source that is much farther from the microphone than in previous examples, an estimated distance of 1.3 miles (2.09 km.). The data plotted include the amplitude versus frequency curve of FIG. 18 and the phase versus frequency plot of FIG. 19. The phase plotted in FIG. 19 is the phase difference between the left and right channels of the microphone.

In this example, the marker point is taken at a frequency of 312.11 Hz, which is at the small peak in phase at the centre of the phase versus frequency plot. This corresponds closely to the sharp peak at the centre of the amplitude versus frequency plot.

EXAMPLE 5

Plots similar to those of FIGS. 18 and 19 are shown in FIGS. 20 and 21 again using a sound source approximately 1.3 miles from the microphone. The marker points in the data are taken at the sharp centre frequency of the amplitude curve, at 310 Hz and at the two minimums on opposite sides of that peak. From the phase versus frequency plot, it is determined that the phase differences for the three marker points are $Ø_1=91°$, $Ø_2=-55°$ and $Ø_3=43°$. Those values represent a sound approaching horizontally and from 90° to the right. Additionally, the amplitude was greater on the right then on the left. These values are used in the process described in the following.

DETERMINATION OF LOCATION AND RANGE

Figure 22:
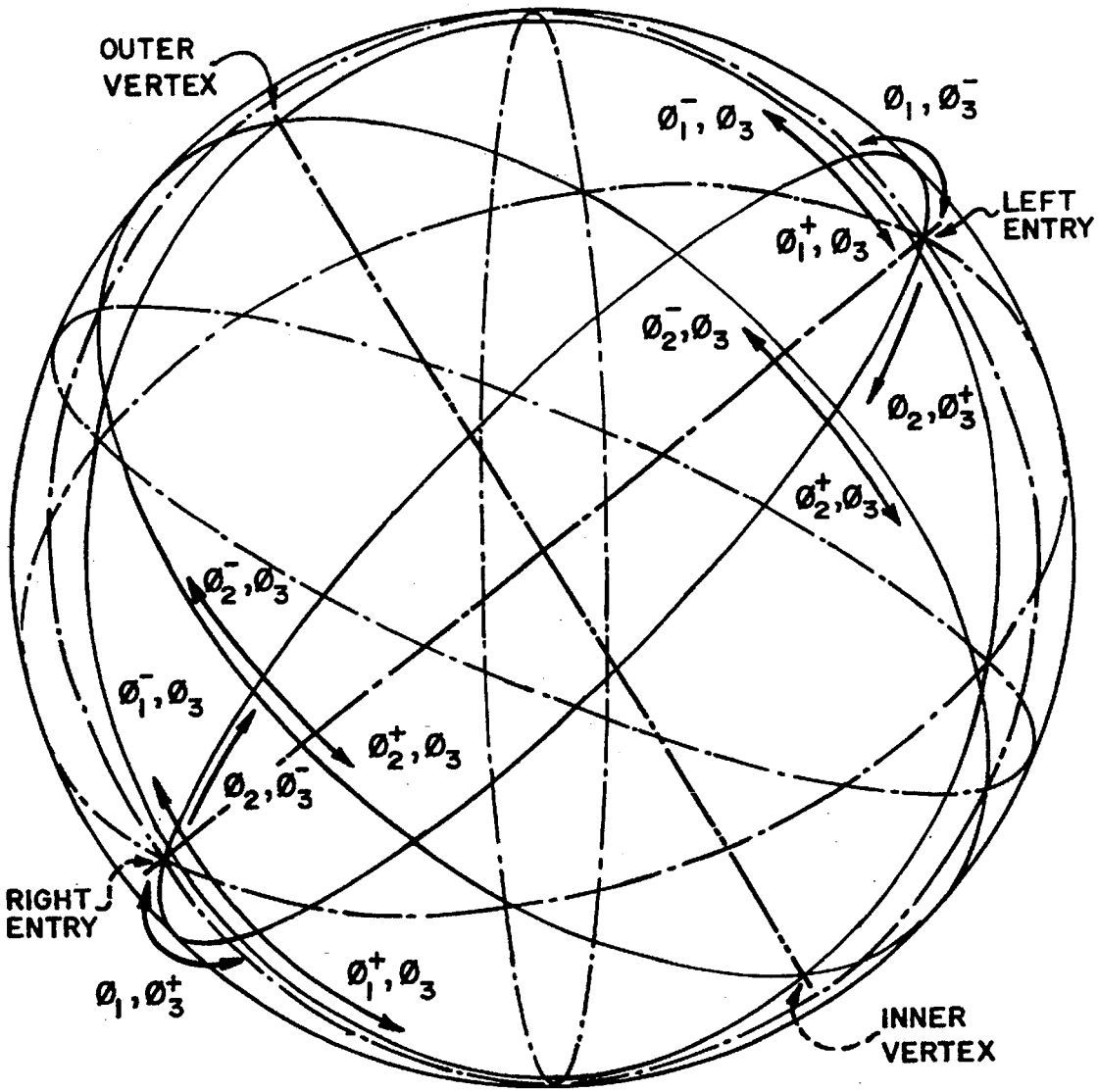
FIG. 22 is an isometric view of a plotting globe for location determination.

It is anticipated that the data described alcove and similar data can be mapped onto a spherical octahedron in the orthogonal position for sound source location and range determination. The procedure is as described in the following and is illustrated in FIG. 22.

CONSTRUCTION OF GLOBE

1. On a spherical object, three great circles are provided such that each intersects each other at 90° at two points. This yields the outline of a spherical octahedron with eight triangular facets, 2. The edge of each triangular facet is bisected and the midpoint of each edge is connected with the midpoint of the two adjacent edges. This yields the outline or topology of a spherical vector equilibrium.

3. The sphere is oriented with one of the great circles as a transverse arc set at 45° to the horizontal and the remaining great circles set so that they intersect anteriorly at a position to be known as the inner vertex and posteriorly at a position to be known as the outer vertex. An oblique line connecting the vertices lies in the midplane, set at 45° from the horizontal and running upward in an anterior-posterior direction.

A horizontal line passes through the transverse arc on each side and through the central plane of the sphere. This defines right and left entry points at the intersection of the horizontal line with the transverse arc.

A further great circle lies in the horizontal plane and passes through the right and left entry points. Another great circle lies in the midline vertical plane such that the anterior intersection between the horizontal great circle and the vertical great circle becomes elevation 0° and azimuth 0°.

DETERMINATION OF LOCATION

The location of a sound source is determined using the marked globe and the phase data generated as shown above in Example 5. The plotting process is described in the following:

1. At the right entry point plot the $Ø_1$ data upwardly and anteriorly on the transverse arc. If $Ø_1$ is greater than 45° and positive, turn right at the first intersection and continue. If $Ø_1$ is negative, turn left and continue.

2. At the right entry point plot the $Ø_2$ data downward and posteriorly on the transverse arc. If $Ø_2$ is greater than 45° and positive turn right at the first intersection. If it is negative, turn left and proceed.

3. At the left entry point plot the $Ø_2$ data upwardly and anteriorly on the transverse arc. If $Ø_2$ is greater than 45° and positive, turn left at the first intersection and continue. If $Ø_2$ is negative, turn right and continue.

4. At the left entry point plot the $Ø_1$ data downwardly and posteriorly on the transverse arc. If $Ø_1$ is greater than 45° and positive, turn right at the first intersection. If it is negative turn left.

5. $Ø_3$ information is mapped bilaterally and equally from the right and left entry points. If $Ø_3$ is positive, proceed anteriorly from the entry point. If it is greater than 135° turn downward and proceed and also turn upward and proceed. If $Ø_3$ is negative proceed posteriorly. If $Ø_3$ is greater than 135° turn downward and upward and proceed.

Each set of plots will yield the vertices of a triangle or quadrangle where the vertices fall on a circle with its centre marked on the sphere. There are two such points on the globe. The centre point on the side with the greater amplitude should be chosen. The elevation and azimuth angle of the point chosen are those to the sound source.

DETERMINATION OF RANGE

Range is determined by dividing the ambient speed of sound by the difference between the two frequency determinants of range. Reference will be made to the specific examples given above.

EXAMPLE 1

FREQUENCIES: first range point (RP1)=12010 Hz second range point (RP2)=11910 Hz RP1–RP2=100 Hz velocity of sound in water≈4860 feet per second (1480 meters per second) range=4860/100=48 feet (14.6 meters). This compares with a measured distance of approximately 45 feet (13.7 meters).

EXAMPLE 2

FREQUENCIES: first range point (RP1)=12030 Hz second range (RP2)=11710 Hz RP1–RP2=320 Hz range=4860/320=15 feet (4.6 meters). This compares with a measured distance of approximately 15 feet (4.6 meters).

EXAMPLE 3

The speed of sound in air is approximately 344 meters per second first range point (RP1)=1.0862 kHz second range point (RP2)=1.0775 kHz RP1–RP2=8.7 Hz range=344÷8.7=39.5 meters. This compares with an estimated range of approximately 40 meters.

EXAMPLE 4

In this case, the sound source is far away and the two frequency determinants of range are subcyclic. In this case, the phase difference is used to determine the range.

Range point (RP)=312.11 Hz phase difference at range point $\Delta Ø$=58.5237° frequency difference $\Delta$ F=58.5/360=0.162 Hz range=344 ÷0.162=2123 meters. This compares with an estimated distance of 2090 meters (1.3 miles).

DYNAMIC OR ROBOTIC SOUND SOURCE DETERMINATION

The microphone of the present invention may be used in a dynamic or robotic sound source location system. For example, the microphone may be mounted in a gimbal mount with a vertical axis of rotation passing through the centre of volume of the microphone and a horizontal axis of rotation passing through the centre of volume and parallel to the long axis of the microphone.

When a sound is detected and assessed on a spectrum analyzer, the plots generated may be used as discussed above to determine the direction and range of the sound source.

When the sound source is detected, the microphone may be rotated in the horizontal plane until the amplitude responses of the two channels are balanced. The amount of rotation is the azimuth of the sound source. This provides a second measure of azimuth.

The microphone is rotated about the horizontal axis until the elevation determination is 0°. The amount of rotation about the horizontal axis is the elevation of the sound source. This provides a second measure of elevation.

With the microphone directed at the sound source the spectrum analysis plots may be used to determine the range of the sound source, providing a second measure of range.

It is believed evident from the foregoing analysis and discussion that by modelling the sound system on the geometry of the human hearing system, it is possible to detect, record and analyze information defining the range and direction of a sound source. It is believed that the microphone system described in the foregoing is an analog of the human hearing system and provides insight into how the human hearing system functions in determining sound source range and direction, giving sound source location.

While the foregoing has provided certain specific examples of the microphone and loudspeaker of the present system, it is to be understood that other. embodiments are possible and are considered to be included within the scope of the present invention.

There are numerous potential applications of the system for detecting and identifying sounds, the positions of their sources and the sources themselves using a sound signature identification. Applications may involve any transmission of sound in a gaseous or liquid medium. Some of the applications envisaged are:

Acoustic navigation for blind persons or vehicles, including aircraft take-off and landing systems;

Acoustic aspects in "virtual reality" systems, e.g. games;

Virtual acoustics systems in such applications as air traffic control;

Exploration for subsurface liquids and gases, e.g. oil, water and natural gas;

Other geological applications, for example earthquake location;

Fog horns;

Wind detectors, giving direction and speed;

Ocean current monitoring; and

Sonar, in any of its applications.

In view of the foregoing, it will be understood that many embodiments and applications of the invention are possible. The invention is therefore to be considered limited solely by the scope of the appended claims.

I claim:

1. A microphone comprising a cylindrical transducer housing (12) with a lateral axis and having a hollow, cylindrical centre section (20) and two end sections (32), the centre section (20) having non-parallel, elliptical end walls (24) oriented mirror-symmetrically with respect to a plane perpendicular to the lateral axis, each end section (32) comprising a solid block, the end sections (32) having inner end faces (34) confronting and parallel to respective ones of the centre section end walls (24), the inner end faces (34) of the end sections (32) being imperforate, the end walls (24) of the centre section (20) being closed, and transducer means consisting of two microphone transducers (26) mounted centrally of the end walls (24) of the center section (20) to receive sound from beween the respective end sections and the centre section.

2. A microphone according to claim 1 wherein each end section (32) has an elliptical outer end face (36) parallel to the inner end face (34) thereof.

3. A microphone according to claim 1 including a base (16) housing (12) for supporting the housing on a surface with long axes of the elliptical end faces (24; 34; 36) converging in a direction sloping towards the surface.

4. A microphone according to claim 1 wherein the elliptical end faces (24) of the centre unit (20) lie in planes intersecting at an angle substantially equal to the dihedral angle of a regular tetrahedron.

5. A loudspeaker comprising:

a cylindrical, hollow housing with a lateral axis (X—X) and having a centre section (50) and two end sections (52, 54), the centre section (50) having non-parallel end faces (58, 59) oriented mirror-symmetrically with respect to a plane perpendicular to the axis, the end sections (52, 54) having inner end faces (60) confronting and parallel to respective ones of the centre section end faces (58, 59); and four speaker transducers (66, 68) mounted in the housing, with two centre transducers (66) in the centre section (50) radiating towards respective ones of the end sections (52, 54), and one end transducer (68) in each of the end sections (52; 54) radiating Towards the centre section (50), each transducer (66; 68) being sealed to the housing; characterized by:

the end sections (52, 54) having closed outer ends (64);

baffle means (70) extending across the centre section (50) between the two centre transducers (66);

aperiodic chamber means (72, 74, 76, 78); and port means (72) for communicating between the housing at the back side of each transducer (66, 68) and the aperiodic chamber means (72, 74, 76, 78).

6. A loudspeaker according to claim 5 wherein each end section (52; 54) of the housing has an outer end face (62) parallel to the inner end face (60) thereof.

7. A loudspeaker according to claim 6 wherein each end face (58, 59, 60, 62) is elliptical.

8. A loudspeaker according to claim 5 wherein the aperiodic chamber means comprise four sealed chambers and the port means communicate between each chamber and the housing at the back side of a respective transducer and including fractal-like bodies filling each said chamber.

9. A loudspeaker according to claim 8 wherein the port means (72) comprise ducts (124) leading from the chambers (78) to the housing, a vibrator body (128) in each duct and air pervious damping means (132) supporting the vibrator bodies in the ducts.

10. A loudspeaker according to claim 9 wherein the damping means comprise a mass of fibrous material.

11. A loudspeaker according to claim 10 wherein the fibrous material comprises steel wool.

12. A loudspeaker according to claim 9 wherein each vibrator body comprises a solid rod (128) extending across the associated duct (124).

13. A loudspeaker according to claim 12 including aligned apertures (126) through opposite sides of each duct (124), the rod (128) extending into the apertures (126), and viscous sealing material (130) filling the apertures around the rod.

14. A loudspeaker according to claim 5 having a centre unit (44) comprising said cylindrical hollow housing and further comprising:

two end units (46, 48), each including a cylindrical housing aligned with and spaced from a respective end of the centre unit (44), each end unit having a hollow centre section (82) and two end sections (84, 86), the centre section of each said end unit having parallel, elliptical end faces (88, 90) oriented substantially parallel to the nearest one of the end faces (58) of the centre section of the centre unit (44), the end sections of each said end unit having elliptical inner end faces (92, 96) confronting and parallel to respective ones of the end faces (88, 90) of the centre section of the respective end unit;

two speaker transducers (104, 106) mounted in the centre section of each end unit and radiating towards respective ones of the end sections of the respective end unit, each transducer (104, 106) being sealed to the housing;

baffle means (108) extending across the centre section (82) of said each end unit between the transducers;

second aperiodic chamber means (114, 116, 118); and second port means (112) for communicating between the end unit housing at the back side of each transducer (104, 106) and the second aperiodic chamber means (114, 116, 118).

15. A loudspeaker according to claim 14 wherein each said end section (84, 86) of each end unit housing comprises a solid block with an axial bore (100, 102) therethrough.

16. A loudspeaker according to claim 15 wherein each said end section (84, 86) of each said end unit housing has an outer end face (94, 98) parallel to the inner end face of each said end section of each said end unit (92, 96) thereof.

17. A loudspeaker according to claim 15 wherein the second aperiodic chamber means (114, 116, 118) of each end unit (48) comprise two sealed second chambers (118) and the second port means (112) communicate between each second chamber and the end unit housing at the back side of a respective speaker transducer (104, 106), and including fractal-like bodies (120) filling each said second chamber.

18. A loudspeaker according to claim 17 wherein the second port means (112) comprise second ducts (124) leading from the second chambers (118) to the end unit housing, a second vibrator body (128) in each second duct and air pervious damping means (132) supporting the second vibrator bodies in the second ducts.

19. A loudspeaker comprising:

A) a centre unit (44) with opposite left and right ends and comprising:

1) a cylindrical, hollow housing with a lateral axis (X—X) and having:

a) a centre unit centre section (50) with non-parallel centre section left and right end faces (58, 59) oriented mirror-symmetrically with respect to a plane perpendicular to the axis, b) a left end section (52) having a right end face (60) confronting and parallel to the centre section left end face (58) and a closed left end (64), and c) a right end section (54) having a left end face (60) confronting and parallel to the centre section right end face (59) and a closed right end (64);

2) four speaker transducers (66, 68) mounted in the housing, including:

a) centre left inner (CLI) and centre right inner (CRI) transducers in the centre section (50) radiating towards the left and right end sections (52, 54) respectively, each extending across and closing the housing, and b) centre left outer (CLO) and centre right outer (CRO) transducers in the left and right end sections (52, 54) respectively radiating towards the centre section (50), each extending across and closing the housing;

3) baffle means (70) extending across the centre section (50) of the housing between the two centre transducers (66);

4) first aperiodic chamber means (72, 74, 76, 78); and 5) first communicating means (72) communicating between the housing at the back side of each transducer (66, 68) and the aperiodic chamber means (72, 74, 76, 78);

B) a left end unit (46), spaced from the left end of the centre unit the left end unit including:

1) a cylindrical housing with a lateral axis aligned with the lateral axis of the centre unit (44), and having:

a) a left end unit centre section (82) having left and right end faces (90, 88) parallel to the centre section left end face (58); and b) two left end unit end sections (84, 86) at opposite ends of the left end unit centre section, each left end unit end section (84, 86) having an inner end face (92, 96) confronting and parallel to a respective one of the left and right end faces (90, 88) of the left end unit centre section (82);

2) two speaker transducers (104, 106) mounted in the left end unit centre section, including end left outer (ELO) and end left inner (ELI) transducers radiating towards the left and right ends respectively of the left end unit centre section; and C) a right end unit (48), spaced from the right end of the centre unit the right end unit including:

1) a cylindrical housing with a lateral axis aligned with the lateral axis of the centre unit (44), and having:

a) a right end unit centre section (82) having left and right end faces (88, 90) parallel to the centre section right end face (58), and b) two right end unit end sections (84, 86) at opposite ends of the right end unit centre section, each left end unit end section (84, 86) having an inner end face (92, 96) confronting and parallel to a respective one of the left and right end faces (88, 90) of the right end unit centre section (82);

2) two speaker transducers (104, 106) mounted in the right end unit centre section, including end right outer (ERO) and end right inner (ERI) transducers radiating towards the left and right end faces respectively of the right end unit centre section.

20. A loudspeaker according to claim 19 including circuit means (134) for generating a left channel signal and a right channel signal, means for delivering the right channel signal to the end left inner (ELI), centre left outer (CLO), centre right inner (CRI) and end right outer (ERO) transducers, and means for delivering the left channel signal to the end left outer (ELO), centre left inner (CLI), centre right outer (CRO) and end right inner (ERI) transducers.

* * * * *